United States Patent [19]

Berger

[11] 4,203,396

[45] May 20, 1980

[54] BARREL ENGINE WITH ROCKING BALL DRIVE

[76] Inventor: Alfred H. Berger, 4143 Nemaha Dr., San Diego, Calif. 92117

[21] Appl. No.: 952,620

[22] Filed: Oct. 19, 1978

[51] Int. Cl.[2] ..... F02B 75/26

[52] U.S. Cl. ..... 123/58 B; 123/58 BB

[58] Field of Search ..... 123/54 R, 54 A, 56 R, 123/56 A, 56 AB, 56 AC, 56 B, 56 BB, 56 BC, 58 R, 58 B, 58 BA, 58 BB

[56] References Cited

U.S. PATENT DOCUMENTS

| | | | |
|---|---|---|---|
| 773,206 | 10/1904 | Hall | 123/58 BA |
| 876,202 | 1/1908 | Lege | 123/58 BA |
| 1,306,639 | 6/1919 | Soemer | 123/58 BA |
| 2,056,088 | 9/1936 | Berry | 123/58 BB |
| 2,278,696 | 4/1942 | George | 123/58 BB |

*Primary Examiner*—Charles J. Myhre
*Assistant Examiner*—Craig R. Feinberg
*Attorney, Agent, or Firm*—Brown & Martin

[57] ABSTRACT

A reciprocating engine having multiple pistons coupled to a ball drive element which is retained in a spherical bearing seat and moves with a rocking motion about plural intersecting axes. Drive pins projecting from the ball element move in conical paths and are coupled eccentrically to output shafts, which provide rotary drive for primary power output and for valve and accessory operation.

9 Claims, 4 Drawing Figures

BARREL ENGINE WITH ROCKING BALL DRIVE

BACKGROUND OF THE INVENTION

In barrel type engines, in which the cylinders are clustered around and parallel to a common axis, various mechanisms have been used to convert reciprocating piston motion to rotary output motion. Typical mechanisms include a nutating disc or swash plate, a universally pivoted rocking yoke, or other such member, coupled to a Z-shaped section in the output shaft. Wobble plate or yoke members have also been used with eccentric output elements coupled to straight shafts. In all these mechanisms the reciprocating to rotary drive structure is subjected to considerable loads and, in turn, often causes off-axis load to be applied to the pistons, resulting in uneven cylinder wear.

In structures in which the motion converting element is not mounted directly on the output shaft, the element is supported only by its connections between the pistons and the shaft. Without support the motion converting element can be moved off center by uneven loads, or by changes in load during acceleration and deceleration of the engine. This causes excessive wear on the various moving parts.

SUMMARY OF THE INVENTION

In the engine described herein the reciprocating to rotary conversion element is a ball, which is mounted in a spherical seat substantially at the center of an engine block and can rock only about a fixed center. The block contains opposed pairs of cylinders in a spaced parallel cluster about the ball, with pistons coupled to arms projecting from the ball. Sequential reciprocation of the pistons drives the ball with a rocking motion about plural axes through the center of pivot.

Pins projecting from the ball between the piston connecting arms are caused by the rocking motion to move in conical paths. The pins are coupled eccentrically to drive members on shafts projecting from the engine. One shaft is used as the primary power output and others are used to actuate valves, ignition timing and accessories as required. By restraining the ball element in a bearing seat, all loads are applied through the ball and offset loads on the pistons and other moving components are minimized, resulting in reduced wear and more efficient operation.

The primary object of this invention, therefore, is to provide a new and improved engine.

Another object of this invention is to provide a barrel engine using a ball element rocking in a spherical seat to convert reciprocating motion of the pistons to rotary output drive.

Another object of this invention is to provide a barrel engine in which unnecessary loads on the moving components are minimized.

A further object of this invention is to provide a barrel engine which is simple and compact for its displacement and power output.

Other objects and advantages will be apparent in the following detailed description, taken in conjunction with the accompanying drawings, in which.

DESCRIPTION OF THE PREFERRED EMBODIMENT

The engine comprises a block 10 containing opposed pairs of cylinders equally spaced about and parallel to a common longitudinal axis. As illustrated the engine has eight cylinders in four pairs, but other arrangements could be used. Cylinders 12A and 12B of one pair contain pistons 22A and 22B, cylinders 14A and 14B contain pistons 24A and 24B, cylinders 16A and 16B contain pistons 26A and 26B, and cylinders 18A and 18B contain pistons 28A and 28B.

At the center of the block 10 on the common axis is a ball 20, rotatably mounted in a spherical seat 30. Portions of the seat are cut away to clear the various arms protruding from the ball 20, but a large portion of the ball is supported in the seat and the ball is limited to a rocking motion.

Figure 1:
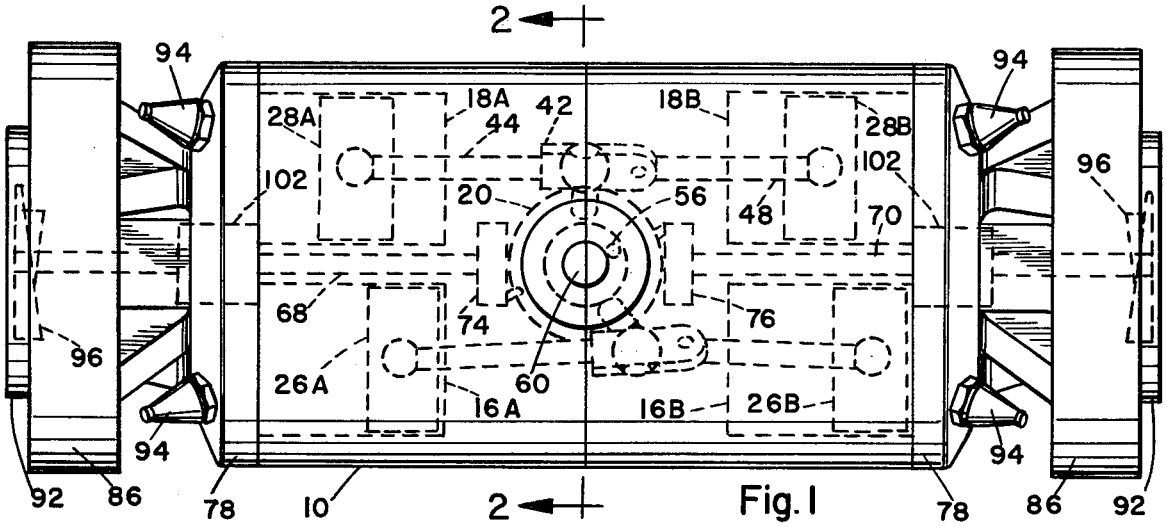
FIG. 1 is a side elevation view of one configuration of the engine.
Figure 2:
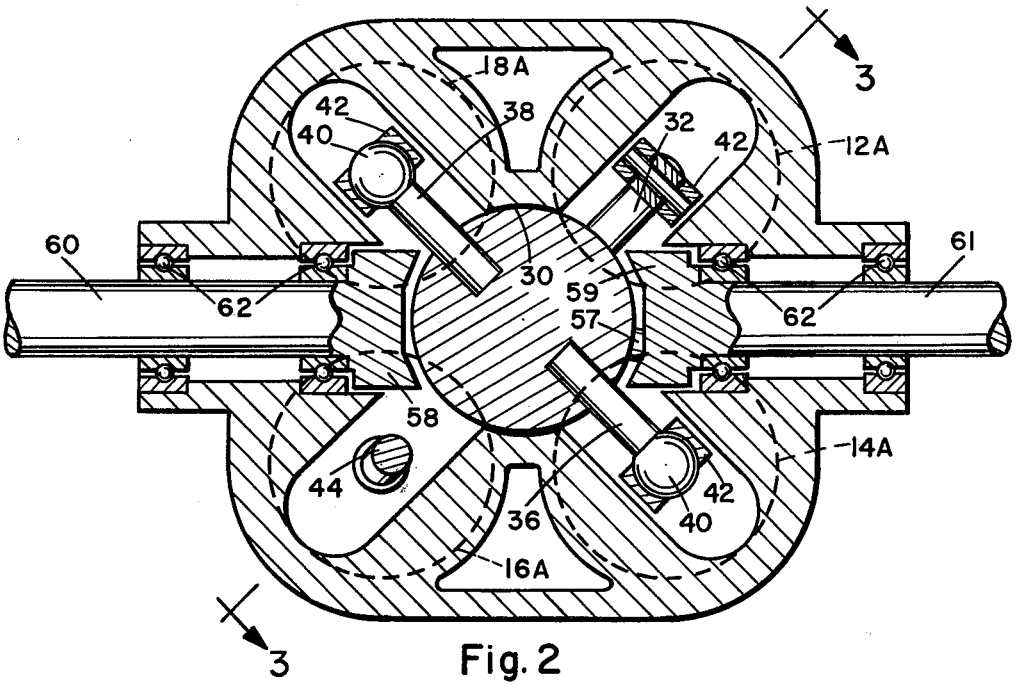
FIG. 2 is an enlarged sectional view taken on line 2—2 of FIG. 1.
Figure 3:
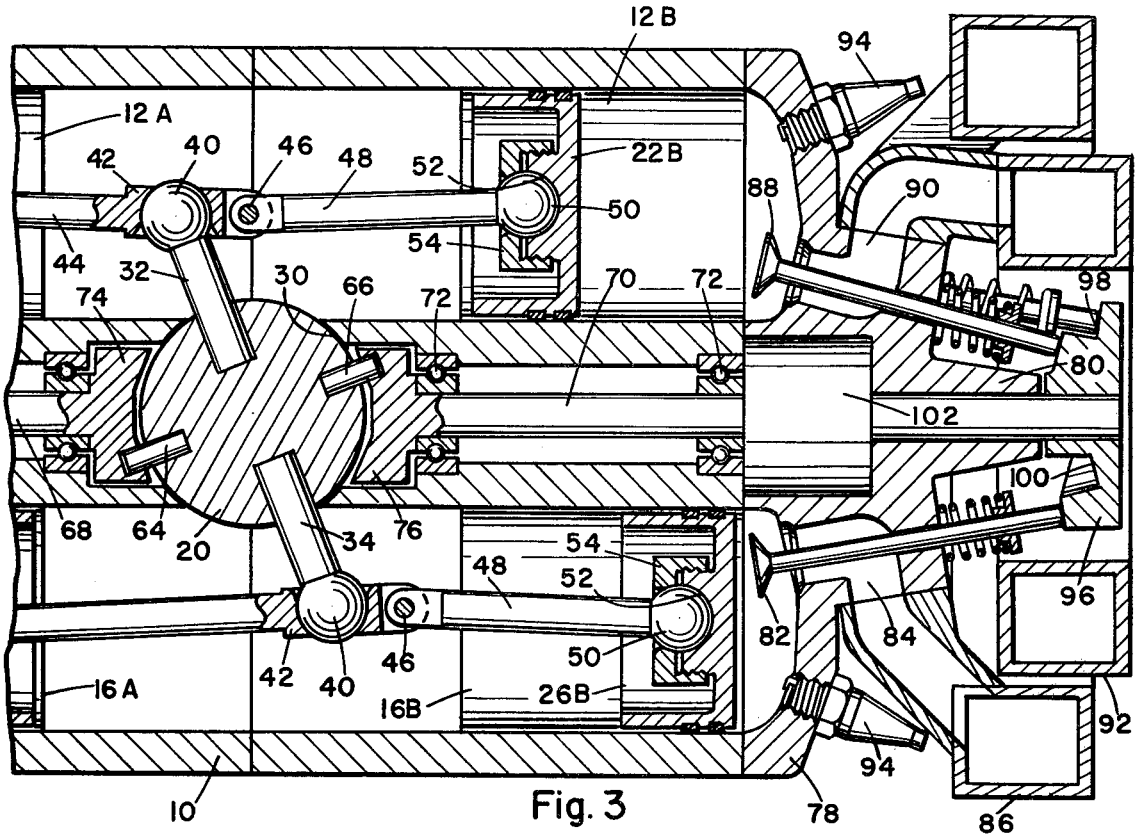
FIG. 3 is a sectional view taken on line 3—3 of FIG. 2.

In the structure as shown the cylinders are spaced at 90 degrees apart around the common axis. Projecting from ball 20 are diametrically opposed arms 32 and 34, and another pair of diametrically opposed arms 36 and 38 orthogonal to the first pair. Arm 32 has a ball end 40, which is rotatably held in a coupling 42 on a connecting rod 44 attached to piston 12A. Pivotally connected to coupling 42 by a hinge pin 46 is a connecting rod 48 attached to piston 12B. Each connecting rod is typically attached to its respective piston by a ball end 50 seated in a socket 52 in the piston and retained by a cap 54, as in FIG. 3.

Arm 34 is coupled by a similar arrangement of connecting rods 44 and 48 to pistons 16A and 16B. Arm 36 is coupled to pistons 14A and 14B and arm 38 is coupled to pistons 18A and 18B, all in the same manner, the corresponding parts being similarly numbered.

Projecting radially from ball 20 between arms 34 and 38 is a primary drive pin 56, which is journalled eccentrically in a drive disc 58 on an output shaft 60. A similar drive pin 57 projects between arms 32 and 36 and is journalled eccentrically in a drive disc 59 on an output shaft 61. The output shafts rotate in bearings 62 and project from opposite sides of block 10 for connection to any mechanism to be driven.

Also projecting from ball 20 are diametrically opposed drive pins 64 and 66 on an axis orthogonal to that of primary drive pin 56. Mounted in the block 10 are camshafts 68 and 70 journalled in bearings 72 and extending along the common axis of the block, the camshafts being on opposite sides of the ball 20 and projecting from opposite ends of the block. On the inner end of camshaft 68 is a drive disc 74, in which drive pin 64 is eccentrically journalled. On the inner end of camshaft 70 is a similar drive disc 76, in which drive pin 66 is eccentrically journalled, as in FIG. 3.

On each end of block 10 is a cylinder head 78 enclosing all four cylinders and having an axially extending hub 80. Each cylinder is provided with an intake valve 82 with an intake part 84 leading to a manifold 86, and an exhaust valve 88 with an exhaust port 90 leading to a manifold 92. Each cylinder also has a spark plug 94, if the engine is of the spark ignition type, or a fuel injector for a diesel. Each camshaft extends through hub 80 and carries a cam 96, having dual concentric cam faces 98 and 100 for operating the intake and exhaust valves in proper sequence and timing. It should be understood that the arrangement of the heads, valves and valve actuating means is merely an example and other configurations may be used. For proper valve timing in a four stroke cycle, a 2 to 1 reduction drive 102 is incorporated in each camshaft to rotate the cam at half the speed of the output shaft.

Figure 4:
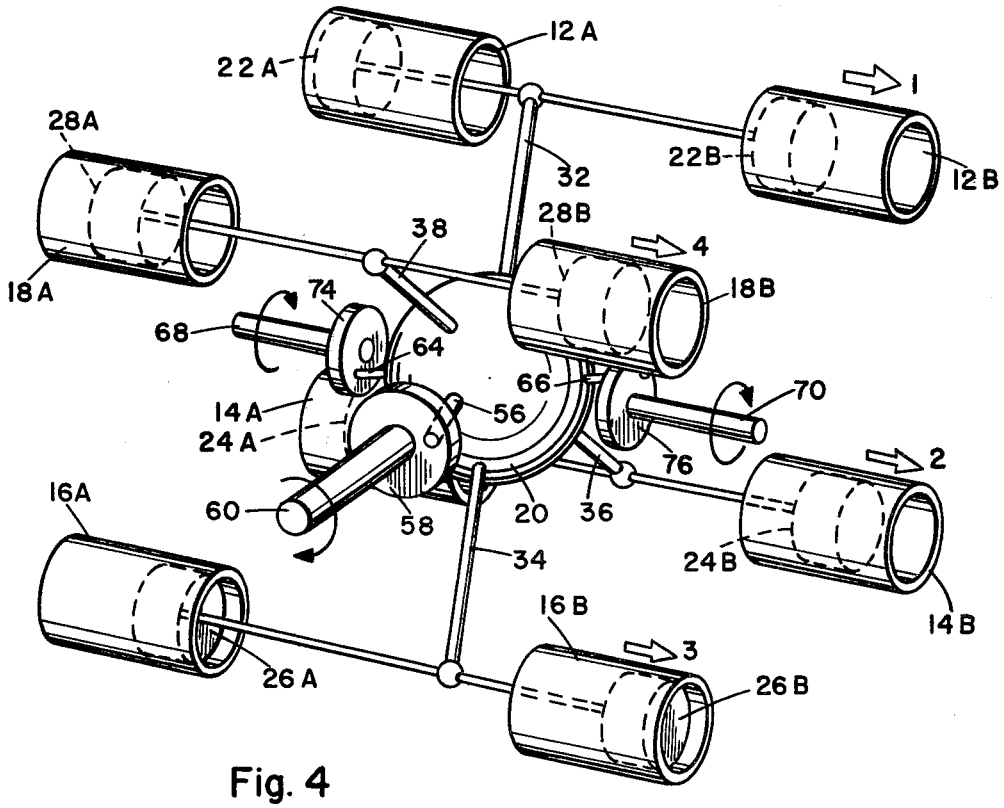
FIG. 4 is a schematic representation of the basic mechanism of the engine.

The operation of the engine is best understood by reference to FIG. 4. It is assumed that the timing of the engine is such that the pairs of pistons move to the right sequentially, as indicated by the directional arrows 1 to 4. Arms 32 and 34 swing in a plane extending diametrically through cylinder pairs 12 and 16, while arms 36 and 38 swing in a plane extending diametrically through cylinder pairs 14 and 18.

As pistons 22A and 22B move to the right, arms 32 and 34 cause ball 20 to rotate substantially about the axis of arms 36 and 38. When pistons 24A and 24B move to the right, arms 36 and 38 cause ball 20 to rotate substantially about the axis of arms 32 and 34. The movement of pistons 26A and 26B and 28A and 28B, in sequence, cause similar rotary motions of the ball in the other two quadrants. It is realized that in the actual operation of the engine the axes are not clearly defined as being those of the specific arms, but it can be seen that the ball does have a rocking motion about two orthogonal axes through its center of radius.

The rocking action causes each of drive pins 56, 57, 64 and 66 to move in a conical path, the tip of each pin having an orbital motion, which rotates its respective drive disc. Thus the reciprocation of the pistons is converted to rotary motion at each of the shafts. Output shafts 60 and 61 provide power for a vehicle or other utilization apparatus, while camshafts 68 and 70 actuate the valves. Ignition timing means can be actuated from either or both camshafts as necessary. Accessory drives for oil and water pumps and other such equipment can be taken from any of the shafts, or from separate eccentric drive connections to the ball element.

It will be evident that all loads and drive couplings are carried through the ball element. By retaining the ball in a secure bearing seat, mechanical stability is maintained and offset loads on the various moving parts are minimized, if not eliminated. Thus the efficiency of the engine is increased and wear is greatly reduced.

It should be understood that the structure as illustrated is exemplary, and that specific configurations and proportions may vary according to the particular purpose and installation of the engine.

Having described my invention, I claim:

1. An engine, comprising:

a block having a plurality of opposed pairs of cylinders spaced around and parallel to a common axis;

pistons reciprocally mounted in said cylinders and coupled in axially aligned pairs;

said block having opposed fixed spherical seats substantially at the center thereof on said common axis;

a ball element rotatably mounted in and supported by said seats;

arms extending substantially radially from said ball on angularly spaced axes, each of said arms being coupled to one of said pairs of pistons;

a drive pin projecting from said ball and spaced from said arms;

an output shaft rotatably mounted in and extending from said block, said shaft having an eccentric drive connection to said drive pin;

and timing means for controlling sequential operation of said pistons to rock said ball element alternately about different axes.

2. An engine according to claim 1, and including a second output shaft extending from said block opposed to said first mentioned output shaft, and having an eccentric drive connection to said ball element.

3. An engine according to claim 1, and including a head fixed on each end of said block, each head having intake and exhaust valves therein at each of said cylinders;

said timing means including actuating means having a driving connection to said ball element and coupled to said valves.

4. An engine according to claim 3, wherein said actuating means includes a pair of camshafts rotatably mounted in said block on the common axis thereof and extending from opposite ends through said heads, each of said camshafts having a cam thereon in engagement with the respective valves;

said ball element having a pair of opposed drive pins projecting therefrom, each with an eccentric drive connection to one of said camshafts.

5. An engine according to claim 1, wherein said cylinders comprise four pairs of cylinders equally spaced around the common axis;

said arms including two pairs of diametrically opposed arms with the pairs orthogonally spaced.

6. An engine according to claim 5, wherein said timing means actuates said pistons sequentially in rotation about the common axis.

7. An engine according to claim 1, wherein said timing means includes a timing shaft rotatably mounted in said block, said ball having a further drive pin projecting therefrom with an eccentric drive connection to said timing shaft.

8. An engine according to claim 2, and including a head fixed on each end of said block, each head having intake and exhaust valves therein at each of said cylinders;

and actuating means on said timing shaft for actuating said valves in timed sequence.

9. An engine according to claim 3, wherein said timing shaft is coaxial with the common axis of said block and extends from an end thereof, said actuating means comprising a cam on said timing shaft in engagement with said valves.

* * * * *